US005177406A

United States Patent [19]

Troxell

[11] Patent Number: 5,177,406

[45] Date of Patent: Jan. 5, 1993

[54] ACTIVE MATRIX VACUUM FLUORESCENT DISPLAY WITH COMPENSATION FOR VARIABLE PHOSPHOR EFFICIENCY

[75] Inventor: John R. Troxell, Sterling Heights, Mich.

[73] Assignee: General Motors Corporation, Detroit, Mich.

[21] Appl. No.: 692,855

[22] Filed: Apr. 29, 1991

[51] Int. Cl.[5] ..... G09G 3/10

[52] U.S. Cl. ..... 315/169.1; 340/781; 340/825.81

[58] Field of Search ..... 315/169.1, 169.3, 169.4, 315/51; 340/781, 825.81

[56] References Cited

U.S. PATENT DOCUMENTS

| | | | |
|---|---|---|---|
| 4,006,383 | 2/1977 | Luo et al. | 315/169.3 |
| 4,528,480 | 7/1985 | Unagami et al. | 315/169.1 |
| 4,602,192 | 7/1986 | Nomura et al. | 315/169.3 |
| 4,851,363 | 7/1989 | Troxell et al. | 437/40 |

OTHER PUBLICATIONS

M. Yoshimura et al., "High-Resolution VFD On-A--Chip", *Society for Information Display Symposium Digestive Technical Papers*, pp. 403-406, 1986.

K. Sera et al., "Poly-Si TFT Active Matrix Vacuum Fluorescent Display", —*Proceedings from Japan Display Conference*, 1989.

S. Uemura et al., "MOS-Addressed VFD Character Display Incorporating Static RAM", —*Society for Information Display Symposium Digestive Technical Papers*, pp. 362-365, 1985.

T. L. Pykosz et al., "Color Graphic Front Luminous VFD", —*Society for Information Display Symposium Digestive Technical Papers*, pp. 366-369, 1985.

David et al., "Twelve Volt Multi Color Vacuum Fluorescent Display", —*SAE Technical Paper Series* No. 880243, International Congress and Exposition, Detroit, Mich., Feb. 29-Mar. 4, 1988.

T. Mizohata et al., "Luminous Efficiency Improvements of Color Phosphors Used in Vacuum Fluorescent Displays", —*SAE Technical Paper Series No.* 900669, International Congress and Exposition, Detroit, Mich. Feb. 26-Mar. 2, 1990.

*Primary Examiner*—Eugene R. LaRoche
*Assistant Examiner*—Michael B. Shingleton
*Attorney, Agent, or Firm*—Robert J. Wallace

[57] ABSTRACT

A pixel switch circuit for performing a select-and-hold function for a pixel within a reconfigurable active matrix vacuum fluorescent display is provided. The pixel switch circuit employs a driver transistor whose geometry can be tailored to optimally match the on-current for the particular phosphor of each pixel. The pixel switch circuit is particularly suitable for vacuum fluorescent displays employing different colored phosphors which have differing luminous efficiencies corresponding to the different colors.

14 Claims, 3 Drawing Sheets

ACTIVE MATRIX VACUUM FLUORESCENT DISPLAY WITH COMPENSATION FOR VARIABLE PHOSPHOR EFFICIENCY

This invention generally relates to reconfigurable vacuum fluorescent displays. More specifically, this invention relates to a reconfigurable active matrix vacuum fluorescent display in which there is provided a semiconductor device associated with each picture element for performing a select-and-hold function as a means for providing the picture element with a local memory, and wherein the semiconductor device includes a driver transistor whose geometry can be tailored to optimally match the on-current for each picture element.

BACKGROUND OF THE INVENTION

Vacuum fluorescent displays (VFDs) are the dominant electronic display technology in current production automotive vehicles, due in part because of the vacuum fluorescent display's generally superior emissiveness, brightness, and environmental and mechanical ruggedness in comparison to its contemporary alternatives; namely, cathode ray tubes (CRTs) and liquid crystal displays (LCDs). As an example, LCDs are well known to be sensitive to temperature extremes frequently encountered within a vehicle while vacuum fluorescent displays are insensitive to such extremes. Vacuum fluorescent displays also operate at low voltages, avoiding both the cost of expensive power supplies and the perceived problems of radiation associated with CRTs. In addition, high brightness vacuum fluorescent displays are suitable for use in automotive "heads-up" displays which are currently entering the market.

As illustrated in FIG. 1, the current state-of-the-art conventional fixed format vacuum fluorescent display generally consists of a number of cathodes 12, a grid 14 and an array of pixels 10 which serve as anodes. The thermionic cathode 12 is typically coated with barium oxide and is directly heated to approximately 600° C. to induce electron emission. Electron emission is further promoted by a positive potential applied to both the grid 14 and the pixels 10. Each pixel 10 is coated with a phosphor corresponding to the color and luminance desired of the particular vacuum fluorescent display. The intervening grid 14 serves to improve the uniformity of brightness of the illuminated elements across the display. The entire package is then evacuated.

A wide variety of colored phosphors have been investigated for use in vacuum fluorescent displays to provide a particularly colored luminance or, alternatively, to provide a multicolored display. However the luminous efficiency of many of these colored phosphors is relatively low. To date, essentially all of the displays utilizing multiple colored phosphors have been fixed format displays—that is, the displays are limited to a fixed configuration and are therefore limited in the type of information which can be provided to the viewer. Reconfigurable vacuum fluorescent displays have been manufactured but are severely limited in application due to very low brightness, limited range of colors and relatively high voltage (150 V) power supply requirements.

These limitations result from the fact that in a conventional reconfigurable display application, each phosphor dot is only powered for a short period of time (which is proportional to the reciprocal of the number of rows in the display). For example, a 400 row display operating at a refresh rate of 60 Hz (that is each row being electrically addressed 60 times per second) would have each pixel powered for a maximum of $42\times10^{-6}$ seconds per cycle, which is a duty factor (that is the fraction of time of which an individual pixel is addressed) of only about 0.25%. To compensate for this very low duty factor, high drive voltages have been used to increase display brightness. However, operation at these high voltages significantly degrades the performance of some colored phosphors, since the phosphors will tend to decompose under the condition of high voltage electron bombardment.

In order to eliminate these performance limitations of the conventional reconfigurable vacuum fluorescent display, it is necessary to provide some form of local memory at each pixel so as to alleviate such adverse consequences, as low brightness, which would otherwise result. The most practical approach to incorporating this local memory capability is the use of a simple transistor select-and-hold circuit at each pixel. With such a circuit, referred to as a pixel switch circuit, the current flow through each pixel can be controlled. The use of thin film transistors to provide the select-and-hold function is known in the art. In particular, the use of polycrystalline silicon (polysilicon) thin film transistors fabricated on glass or oxidized silicon substrates have demonstrated the required performance parameters, such as high reliability. An example of such a thin film transistor is a P-channel metal-oxide semiconductor field-effect transistor (MOSFET).

The basic structure of such a pixel switch typically incorporates three transistors and one storage capacitor. Two select transistors operated in series, though one select transistor is sufficient under some circumstances, are operated with their gate voltages supplied by a particular row of the display. The source voltage for the first select transistor is supplied by a particular column of the display. When both the particular column and row voltages are "on", the select transistors conduct and pass the electrical charge from the column contact to the storage capacitor. In turn, the voltage on this storage capacitor turns on the driver (or "pass") transistor which allows current to flow from the phosphor to ground, resulting in light emission from the phosphor. Performance of the pixel switch circuit is determined by the capability of the individual components, in particular the driver transistor and the capacitor. The current flow from the phosphor, which determines the phosphor's level of light output, is directly limited by the capacity of the driver transistor to allow on-current to flow to ground. As a consequence, in the case of multicolor reconfigurable vacuum fluorescent displays where different color phosphors having different luminous efficiencies, and correspondingly different current requirements, lie on adjacent pixels, the optimal current flow of each phosphor will differ accordingly. This is particularly true when an attempt is made to achieve color balance, that is the relative control over the emissive wavelength by a phosphor, which can then allow the observer to perceive a wide variety of colors with only the use of two or three colors. In addition, even with the different current flow requirements, the total storage capacitance at each pixel—as determined by the combined capacitance of the driver transistor and the capacitor—should be identical to achieve identical addressing characteristics and charge retention time.

Therefore, it would be advantageous to provide a pixel switch circuit for an active matrix vacuum fluorescent display in which there is provided a driver transistor which can be tailored to match the optimal on-current flow from the phosphor according to the luminous efficiency of the phosphor. It would also be advantageous that such a driver transistor be a MOSFET device whose capacitance is compensated with a capacitor which is tailored to maintain an optimal storage capacitance for each pixel switch circuit regardless of the phosphor being controlled.

SUMMARY OF THE INVENTION

It is an object of the present invention to provide an active matrix vacuum fluorescent display with a pixel switch circuit which is suitable for use at high temperatures and in high performance applications.

It is a further object of this invention that such a pixel switch provide a select-and-hold function which is capable of controlling the current flow from the associated phosphor, wherein the select-and-hold function is performed by at least one select transistor and a driver transistor having a capacitance associated therewith.

It is still a further object of this invention that the driver transistor have a geometry which can be tailored to optimally match the on-current flow from the phosphor with the performance of that particular phosphor.

It is yet another object of this invention that the driver transistor be a MOSFET device whose capacitance can be complemented by a capacitor whose geometry is tailored to maintain an optimal storage capacitance for the pixel switch circuit.

In accordance with a preferred embodiment of this invention, these and other objects and advantages are accomplished as follows.

A pixel switch circuit is provided for use in selecting and controlling an individual pixel among a plurality of pixels disposed within an active matrix vacuum fluorescent display. In addition to a cathode and grid associated with a conventional vacuum fluorescent display, the pixel switch is provided in conjunction with conventional components of a pixel; namely a phosphor, an electrically conductive row and column defining a matrix, and a ground. Each phosphor is preselected for having a desired color and/or luminous efficiency. The pixel is designated within the active matrix vacuum fluorescent display by a unique row and column address on the respective row and column. The pixel switch includes a device for selecting the pixel through signals acquired from the row and column, a driver transistor which is in electrical contact with the selecting device, a device for controlling the charge transferred to the driver transistor, and a predetermined capacitance built into the driver transistor.

Both the selecting device and the controlling device can be effectively performed by at least one select transistor. The select transistor has a gate electrode in electrical contact with the row of the matrix, a source electrode in electrical contact with the column of the matrix, and a drain electrode in electrical contact with the driver transistor. The driver transistor is of the MOSFET type having a gate electrode in electrical contact with the drain electrode of the selecting transistor, a drain electrode in electrical contact with ground, and a source electrode in electrical contact with the phosphor. The capacitance associated with the driver transistor provides a storage capacitance enabling the driver transistor to attain a predetermined charge storage capability necessary to optimally perform with the particular phosphor. The select transistor controls the storage of the charge on the driver transistor through instructions received through the row and column signals.

The driver transistor is configured "in-series" between the phosphor and ground, and thereby is the device which directly controls the amount of current, and thus the light output, from the phosphor. The on-current flow from the phosphor is determined by the channel width of the driver transistor, which in turn is defined by that transistor's gate region overlap of the underlying active polysilicon layer. The overlap defines the driver transistor's channel which is abutted at one end by the driver transistor's source electrode and at the opposite end by the driver transistor's drain electrode. The on-current through the driver transistor increases as the channel width is increased.

Accordingly, the channel width of the driver transistor is of primary importance for purposes of the present invention. By varying the channel width of the driver transistor, the on-current which flows through the pixel can be varied, independent of the addressing conditions. Thus, in the case of multicolor reconfigurable displays, where different color phosphors with different luminous efficiencies lie on adjacent pixels, the switching (or driver) transistor for each pixel can be tailored to optimally match the performance of the associated phosphor. It is understood that a variation in channel length of the driver transistor can also provide some degree of control in this manner, but the length is influenced more by the physical and electrical characteristics of the transistor, therefore the use of channel width is preferred.

In addition, the width of the channel also determines in part the total charge storage capability of the pixel switch circuit. To compensate for any decrease in capacitance as a result of smaller channel widths, the driver transistor may be assisted by a distinct charge storage capacitor in electrical contact with the drain electrode of the select transistor. Accordingly, the driver transistor and the storage capacitor together have a combined capacitance which constitutes the total charge storage capability of the pixel switch. Consequently, the capacitance of the driver transistor and the storage capacitor must be balanced to provide a charge storage capability which is sufficient to ensure optimal performance of the phosphor.

Generally, the method of optimally sizing the driver transistor and storage capacitor is as follows. A phosphor is selected on the basis of the desired color and luminous efficiency. The channel width of the driver transistor is then sized in view of the optimal on-current flow of the phosphor. The storage capacitance resulting from the particular channel width of the driver transistor is then determined. Finally, the capacitance required of the storage capacitor is determined on the basis of an inversely proportional relationship to the capacitance of the driver transistor. It is foreseeable under such an analysis that suitable capacitance can be realized from a sufficiently large driver transistor such that the need for a capacitor is alleviated.

A particularly advantageous feature of this invention is that total storage capacitance of the pixel can be maintained while simultaneously providing optimal performance of the phosphor. It is desirable that the total storage capacitance at each pixel—as determined by the combined capacitance of the driver transistor and the capacitor—be identical to achieve identical addressing characteristics and charge retention time.

Other objects and advantages of this invention will be better appreciated from the detailed description thereof, which follows.

BRIEF DESCRIPTION OF THE DRAWINGS

The above and other advantages of this invention will become more apparent from the following description taken in conjunction with the accompanying drawing wherein.

DETAILED DESCRIPTION OF THE PREFERRED EMBODIMENTS

We are the first to provide an active matrix vacuum fluorescent display having a pixel switch circuit which is adaptable for use with phosphors of different colors and efficiencies wherein the pixel switch circuit utilizes a driver transistor whose geometry is tailored to optimize the on-current flow and the charge storage capability of the pixel switch circuit for ensuring optimal performance of the phosphor.

Figure 1:
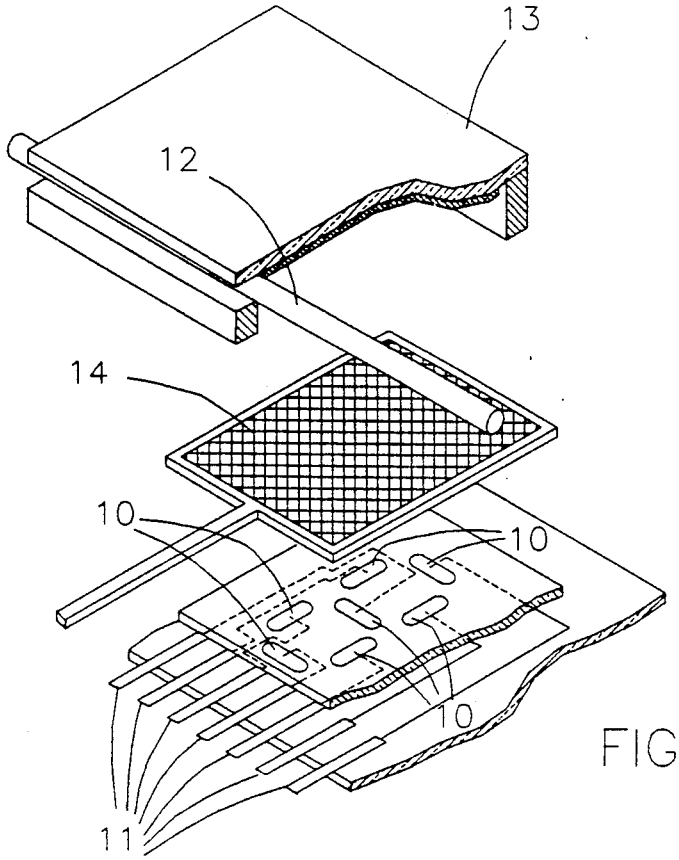
FIG. 1 is a perspective exploded view of the conventional components of a vacuum fluorescent display.

The active matrix vacuum fluorescent display of the present invention, as noted with the conventional vacuum fluorescent display illustrated in FIG. 1, includes a number of cathodes 12, a grid 14 and an array of pixels 10 each having a phosphor anode 16 (as better illustrated in FIG. 2), wherein appropriate electrical connections 11 are provided to each pixel 10 within the array. The cathode 12 typically contains a hot wire filament which is heated to approximately 600° C. to induce electron emission. Electron emission is further promoted by a positive potential applied to both the grid 14 and the phosphor 16. In addition, the grid 14 has a positive potential with respect to the phosphor 16. The phosphor 16 is preferably formed on an aluminum conductor which is coated with the phosphor composition corresponding to the color and luminance desired for the particular vacuum fluorescent display. The grid 14 serves to improve the uniformity of brightness of the illuminated pixels 10 across the display. An outer covering or package 13, generally formed from glass, is also provided.

Figure 2:
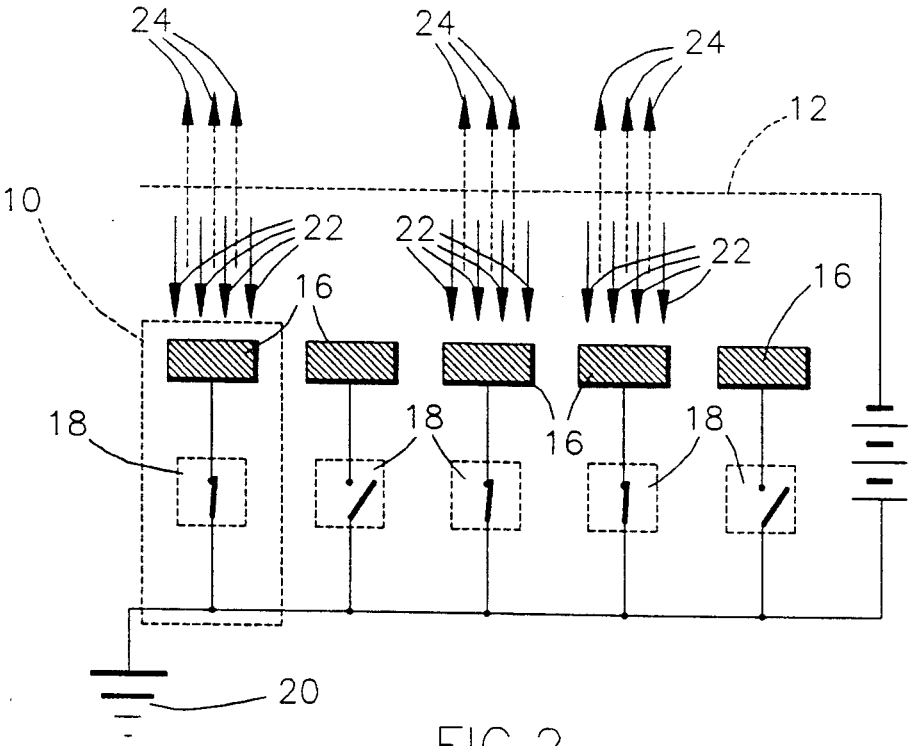
FIG. 2 schematically illustrates a pixel having a pixel switch circuit in accordance with this invention.

As schematically illustrated in FIG. 2, each pixel 10 is provided with a pixel switch circuit 18 for regulating the on-current flow through each pixel 10. The on-current flow is created by the absorption by the phosphor 16 of the electrons 22 emitted by the cathode 12. When the pixel switch circuit 18 is open, on-current flow from the phosphor 16 is interrupted and is thus prevented from flowing to ground 20, as depicted by the two pixel switch circuits 18 having no electron movement. Because electron bombardment of the phosphor 16 is required for the phosphor 16 to fluoresce, as depicted by the three pixel switch circuits 18 showing electron movement, selective interruption of the current (resulting from electron bombardment) by the pixel switch circuit 18 effectively regulates the illumination of the pixel's phosphor 16, and thus the light 24 pattern emitted by the vacuum fluorescent display.

Figure 3:
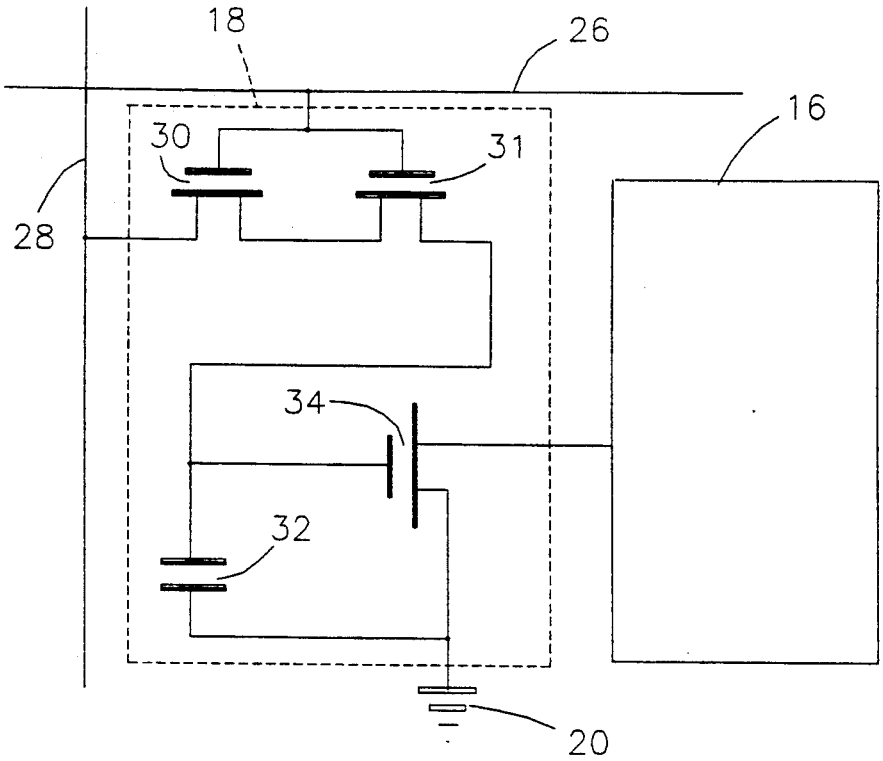
FIG. 3 schematically illustrates the preferred pixel switch circuit for the selecting and control of a phosphor in accordance with this invention.
Figure 4:
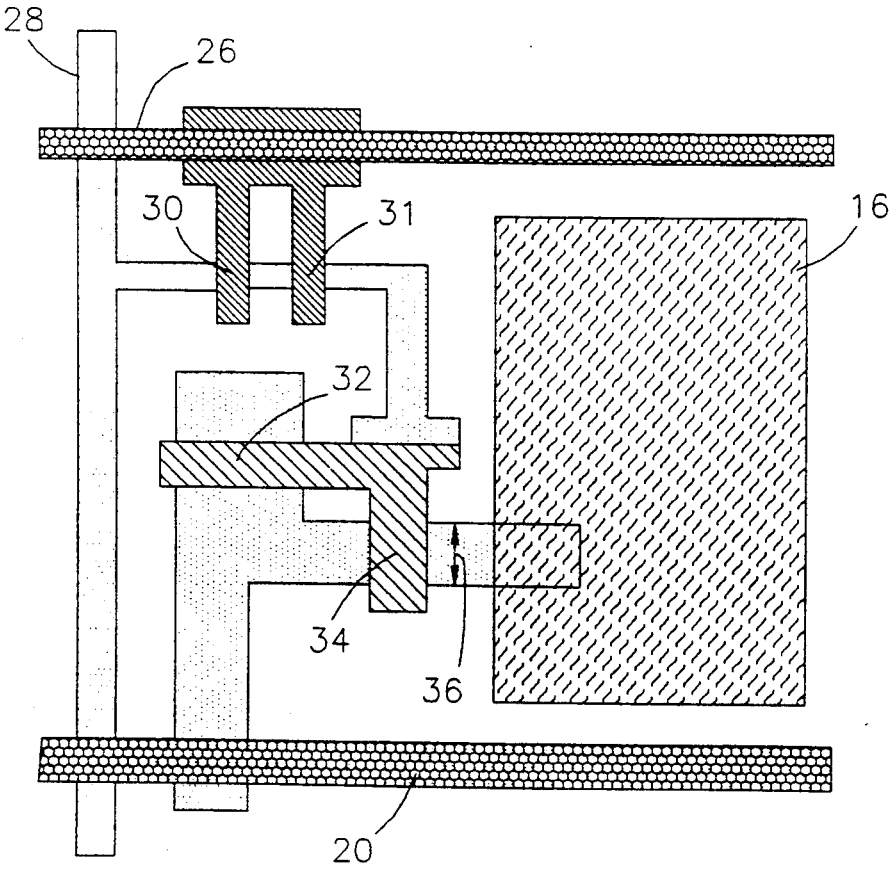
FIG. 4 qualitatively illustrates the pixel switch circuit of FIG. 3.

With reference now to the schematic representation of FIG. 3 and the qualitative representation of FIG. 4, each pixel 10 is assigned a particular row and column address on the vacuum fluorescent display's row and column matrix which is composed of an electrically conductive row 26 and column 28. The row 26 is preferably made of a conductive metal, such as aluminum, while the column 28 is preferably made of a semiconductive material, such as polysilicon, since, as will be explained more fully later, it is formed concurrently with the polysilicon active transistor components. The pixel switch circuit 18 of the present invention consists of at least one select transistor 30 and 31, a source of capacitance, such as a distinct charge storage capacitor 32, and a driver transistor 34.

The select transistors 30 and 31 and the driver transistor 34 are preferably of the MOSFET type, wherein each transistor includes a gate, source and drain electrode. In a preferred embodiment of the present invention, it is preferable that the transistors 30, 31 and 34 be a p-channel MOSFET device, as will be explained in more detail later.

Where two select transistors 30 and 31 are provided, as depicted in FIGS. 3 and 4, the gate electrodes of both the first and second select transistors 30 and 31 are in electrical contact with the row 26 of the matrix. The source electrode of the first select transistor 31 is in electrical contact with the column 28 of the matrix and the drain electrode of the first select transistor 30 is in electrical contact with source electrode of the second select transistor 31. The drain electrode of the second select transistor 31 is in electrical contact with the gate electrode of the driver transistor 34, which in turn furnishes an electrically conductive path to the capacitor 32. The source electrode of the driver transistor 34 is in electrical contact with the phosphor 16 and its drain electrode is in electrical contact with ground 20. The capacitor 32 is also in electrical contact with ground 20.

Under circumstances where it is sufficient or preferable to provide the pixel switch circuit 18 with only one select transistor 30, the drain electrode of the first select transistor 30 is in direct electrical contact with the gate electrode of the driver transistor 34. Otherwise, the remaining electrical connections remain the same except for having one select transistor 30 substituted for the two select transistors 30 and 31 in series. In practice, only one select transistor is required to perform the desired functions described above. However it is generally preferred to use at least two select transistors 30 and 31, as shown, to achieve a cleaner charging signal by reducing the amount of charge leakage away from the driver transistor 34. Consequently, it can be seen that many more transistors could be provided in parallel to achieve these benefits. However, two appear to optimize the benefits while maintaining the practicality of the device.

The select transistors 30 and 31 generally perform two functions within the pixel switch circuit 18. The first is to identify and select each pixel 10 from among the other pixels 10 of the vacuum fluorescent display through instructions received via signals carried by the row 26 and column 28. The second function is to control the storage of an electrical charge on the driver transistor 34 and capacitor 32 for a purpose to be explained below. As such, through the select transistors 30 and 31 each pixel 10 is ultimately identified and controlled by an external control circuitry (not shown). The two select transistors 30 and 31 are operated in series, with their gate voltages supplied by the row 26, while the drain voltage of the first select transistor 30 is supplied by the column 28. When both the column and row voltages are "on", the select transistors 30 and 31 conduct and pass charge from the column contact to the driver transistor 34 and the capacitor 32.

In turn, the voltages on the driver transistor 34 and the capacitor 32 then turn on the driver transistor 34, which allows current (on-current) to flow from the phosphor 16 to ground 20, resulting in light emission from the phosphor 16 characterized by the color and luminance efficiency of the particular phosphor composition. Lower efficiency of a phosphor 16 requires a higher on-current flow as compensation to provide uniformity in the various colors within the vacuum fluorescent display, or to provide some specific non-uniform color matching. In terms of the magnitude of the on-current flow from the phosphor 16, the on-current is proportional to the size of the driver transistor 34, and more specifically to the width of the transistor channel 36.

As seen in FIG. 4, the channel 36 is defined by the driver transistor gate region overlap of the active polysilicon layer, which will be described in greater detail later. The overlap defines the driver transistor's channel 36 and is abutted at one end by the driver transistor source electrode and at the opposite end by the driver transistor drain electrode. (For purposes of more clearly describing this invention, the lead line for reference numeral 36 is directed to the width of the driver transistor channel.) In a specific example, the length of the driver transistor channel 36 was approximately 10 microns while the width of the channel was approximately 100 microns. In comparison, the select transistor channels were approximately 15 microns long with a width of approximately 10 microns. The on-current from the phosphor 16 through the driver transistor 34 increases as the width of the channel 36 is increased and decreases as the width of the channel 36 is decreased from the conventional channel length.

The width of the driver transistor channel 36 is additionally important in terms of the total charge storage capability of the pixel switch circuit 18. In addition to determining the on-current flow from the phosphor 16, the width of the channel 36 also determines in part the total charge storage capability of the pixel switch circuit 18. Strictly in terms of capacitance, the width of the channel 36 and the size of the capacitor 32 required for adequate operation of the pixel switch circuit 18 is determined by satisfying the following two conditions; namely, that the total charge storage capability of the driver transistor 34 and the capacitor 32 should be capable of being stored during one cycle, and that the driver transistor 34 and the capacitor 32 should be able to hold the signal for one frame period.

The inherent capacitance associated with the driver transistor 34 enables the driver transistor 34 to contribute a charge storage capability necessary for the pixel switch circuit 18 to operate the phosphor 16. This inherent capacitance is proportional to the geometry of the driver transistor 34 and specifically the product of channel width 36 and channel length. The sole function of the capacitor 32 is to supplement any deficiency in the charge storage capability resulting from inadequate capacitance contributed by the driver transistor 34. Such a deficiency results when the width of the channel 36 is reduced to match the on-current requirement of the phosphor 16.

Accordingly, the driver transistor 34 and the capacitor 32 together have a combined capacitance which constitutes the total charge storage capability of the pixel switch 18. Consequently, the capacitance of the driver transistor 34 and the capacitor 32 must be balanced to provide a charge storage capability which is sufficient to ensure optimal performance of the phosphor 16. The relationship between the width of the channel 36 and the size of the capacitor 32 is therefore proportional and inverse.

The preferred method for forming the pixel switch circuit 18 of the present invention is generally described as follows. A substrate is provided, preferably a conventional single crystal silicon which is crystallographically oriented along the [100] plane. Alternatively, glass substrates such as Corning Code 1729 glass substrates have been used when processed according to U.S. Pat. No. 4,851,363 to Troxell et al. Because the substrate here provides only physical or mechanical support for subsequent processing, the preferred silicon substrate is blanket deposited with silicon dioxide to a preferred thickness of about 1 micron to form an electrically insulating dielectric layer. Alternatively, silicon dioxide thicknesses of about 1000 Angstroms to 2 microns for this purpose are known in the art. However, thickness is critical in that a silicon dioxide layer which is too thin will allow current leakage while a layer which is too thick creates greater stress due to differing thermal coefficients and crystallographic lattice constants between the substrate layer and the silicon dioxide layer.

Next, an active polysilicon layer is deposited using any conventional deposition process to provide a network for charge carrier movement within the pixel switch circuit 18. Specifically, the active polysilicon layer forms the column 28 and the electrical conducting paths between the pixel switch circuit components; namely, the column 18, the select transistors 30 and 31, the driver transistor 34, the phosphor 16, the capacitor 32 and ground 20. The preferred thickness is approximately 2000 Angstroms, though a range of several hundred Angstroms to approximately 5000 Angstroms is typical. A critical aspect of the thickness of the active polysilicon layer is that the subsequent doping process should be able to affect the entire thickness of the active polysilicon layer without unwanted excessive lateral diffusion.

A preferred process for patterning this layer is disclosed and fully described in copending U.S. patent application, Ser. No. 07/508,158 to Troxell et al, entitled "Enhanced Thin Film Transistor and Performance by Semiconductor-Insulator Conversion Encapsulation", which is incorporated herein by reference. The active polysilicon layer is first masked and silicon dioxide is grown until the polysilicon is completely converted to silicon dioxide in those regions where conduction is not desired. The mask is then removed and the silicon dioxide layer is allowed to continue to grow to the desired thickness of approximately 600 Angstroms with a range of approximately 100 Angstroms to approximately 1200 Angstroms being acceptable. This layer of silicon dioxide provides the gate insulator layer and is preferably thermally grown, but can alternatively be conventionally deposited. Also, a thickness of 600 Angstroms has been found to be preferable for optimizing the influence of the gate insulator on the mobility of the charge carriers within the active polysilicon layer. As such, the active polysilicon layer is completely enveloped by the silicon dioxide layer to prevent cross-communication between the circuit components.

An optional but preferred step for forming polysilicon field-effect transistors, which are characterized by charge carrier mobility which is less than that of a single crystal silicon substrate, is to implant either fluorine or hydrogen within the active polysilicon layer to the performance of the transistors. The fluorine or hydrogen atoms act to "tie up" any loose grain boundaries between the individual polysilicon grains, thus improving the mobility of the charge carriers.

The entire surface of the pixel switch circuit is then masked except for the location of the capacitor and the gate regions of the select transistors 30 and 31, the driver transistor 34. A gate polysilicon layer is then deposited in these "islands" to a preferable thickness of about 5000 Angstroms, with a range of between approximately 3000 Angstroms to approximately 1 micron being acceptable. This preferred thickness tends to optimize the effects on the charge carrier mobility in the underlying channel while considering the processing parameters. As previously noted, it is the overlap of the gate region with the active polysilicon layer that defines the channel 36, in addition to defining the subsequent locations of the source and drain regions of the transistors 30, 31 and 34.

The gate, source and drain regions are then appropriately formed using conventional doping processes known in the art. In a preferred embodiment, the transistors 30, 31 and 34 are preferably p-channel MOSFET devices, wherein the source, drain and gate regions are appropriately doped with an element having 3 valence electrons, such as boron, so as to be electrically p-type. Alternatively, the source and drain regions could be doped p-type and the gate n-type. In addition it is foreseeable that this invention could also be practiced with a combination of p-channel and n-channel devices wherein either type of transistor is formed using any of the known methods.

A passivation step is then completed wherein the entire pixel switch circuit 18 is first covered with a silicon nitride layer by plasma deposition. The plasma deposition process is carried out at about 275° C. with a high hydrogen gas ($H_2$) content. Then a high temperature anneal is conducted to allow the hydrogen to "tie up" the polycrystalline silicon at the grain boundaries. This silicon nitride layer is preferably about 1.2 microns in thickness, however a thickness of about 8000 Angstroms is generally considered a minimum so as to ensure sufficient hydrogen for passivation.

Vias are then etched in any conventional manner to provide openings through which electrically conductive paths can be formed between the active polysilicon layer and the gate polysilicon islands which form the transistors 30, 31 and 34, and the capacitor 32. The electrically conductive paths are typically formed by deposits of aluminum or an aluminum alloy introduced at the vias. In addition, a layer of aluminum is concurrently deposited to form the row 26, the ground 20, and an electrically conductive pad (not shown) located where the phosphor composition will be subsequently deposited to form the phosphor 16. The thickness of this aluminum layer is preferably 1.5 microns with a range of approximately 1 to 2 microns. The preferred thickness is sufficient to ensure a highly conductive path while avoiding waste and other such impracticalities.

Next a second layer of silicon nitride, again having a preferred thickness of about 1.2 microns, is formed which serves as a capping layer over the entire pixel switch circuit 18 except for the phosphor pad (which is under and which may identically shaped as phosphor 16 as shown) and the external connections (not shown) to the pixel switch circuit 18. This second layer of silicon nitride acts to prevent random movement of electrons between the active polysilicon layer and ground 20.

The desired phosphor composition is then deposited on the phosphor pad to a thickness of about 25 to 40 microns to form the phosphor 16. As will be described in fuller detail below, the phosphor composition is typically a transition metal oxide doped with indium-tin oxide to make the phosphor 16 electrically conductive.

The remaining components of the pixel 10, such as the grid 14 and the cathode filaments 12 shown in FIGS. 1 and 2, and the electrical connections (not shown) are then conventionally constructed to form the completed pixel 10.

A significant advantage of the present invention as described above is that by varying the width of the channel 36, the on-current which flows through the pixel 10 can be varied, independent of the addressing conditions. Any consequential deficiency in the total charge storage capacity of the pixel switch circuit 18 can be compensated by altering the size of the capacitor 32. Thus, in the case of multicolor reconfigurable vacuum fluorescent displays, where different color phosphors 16 with different luminous efficiencies lie on adjacent pixels 10, the driver transistor 34 for each pixel 10 can be geometrically tailored to optimally match the on-current requirements of the associated phosphor 16. Having ascertained the required channel width, the optimal size of the capacitor 32—or whether a capacitor 32 is required at all—can then be determined.

It is believed that generally, the luminance of the phosphor 16 can be related to the channel width 36 of the driver transistor 34 by the following equations.

$$L = (\text{Alpha} \times I_p/A_p) \times [V - (I_p \times R_t)] \quad (1)$$

and $$R_t = \text{Beta} \times L_t/W_t \quad (2)$$

where L is the luminance of the phosphor 16, Alpha is a constant depending upon the material properties of the phosphor 16, $I_p$ is the current through the phosphor 16, $A_p$ is the surface area of the phosphor 16, V is the applied voltage, $R_t$ is the resistance of the driver transistor 34, Beta is a constant depending upon the material properties of the driver transistor 34, $L_t$ is the length of the driver transistor 34 and $W_t$ is the width of the driver transistor 34.

In the present invention, the select transistors 30 and 31 and the total charge storage capability at each pixel 10 are identical. The only difference arising between pixels 10 having different colored phosphors—and thus, by assumption, phosphors with different efficiencies, which therefore require different levels of on-current to produce a chosen level of light output—will be the geometry of the driver transistor 34, and the geometry of the capacitor 32 if needed. For a phosphor 16 having a lower luminous efficiency, the corresponding driver transistor 34 will have a wider channel 36. Conversely, for pixels 10 which have a phosphor 16 which exhibits a higher luminous efficiency, the driver transistor channel 36 will have a reduced width. Under all circumstances, the total storage capacitance of the pixels 10 within a given vacuum fluorescent display will be identical. In this way, the addressing characteristics and charge retention time of each pixel 10 will be identical with no adverse effects from varying the geometry of the associated driver transistor 34.

Figure 5:
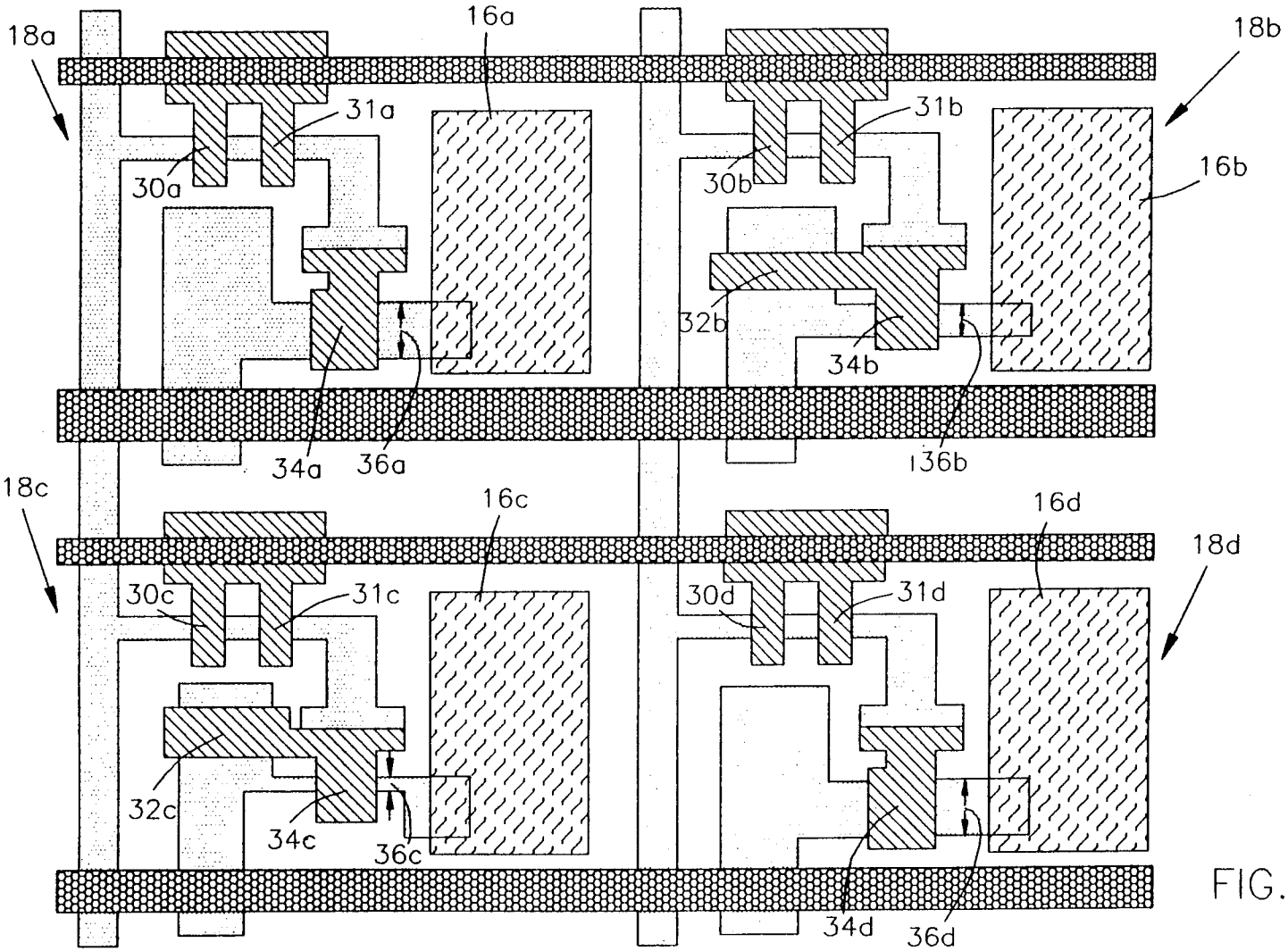
FIG. 5 qualitatively illustrates four sets of adjacent pixel switch circuits in accordance with this invention in which the driver transistor and capacitor are altered to perform optimally with their respective phosphors.

FIG. 5 is a qualitative description of a typical proposed transistor array configuration for a reconfigurable vacuum fluorescent display which has four pixels 18 using three different phosphors 16 having three different efficiencies on the adjacent pixels 18.

As shown in pixel switch circuit 18A, (the upper-left and lower-right quadrants) and described above, the driver transistor 34A, which controls the on-current to the phosphor 16A having the lowest efficiency, has the largest channel width 36A. Consequently, no capacitor 32 is required in pixel switch circuit 18A. The select transistors 30A and 31A are essentially identical throughout the adjacent pixels 18A, 18B and 18C.

In pixel switch circuit 18B (upper-right quadrant), the more efficient phosphor 16B requires a channel 36B with a smaller width to produce a comparable light output in the completed display. Due to the smaller size of driver transistor 34B, it is necessary to provide a capacitor 32B to maintain the total charge storage capacity of the capacitor/transistor combination the same as that in pixel switch circuit 18A.

Similarly, the phosphor 16C in pixel switch circuit 18C (lower-left quadrant) has the highest efficiency, and therefore requires the smallest on-current to achieve a light output compatible with phosphors 16A and 16B. Consequently, driver transistor 34C has the smallest channel 36C but also requires the largest capacitor 32C.

A wide variety of colored phosphors have been investigated as shown in the following table which is reproduced from SAE Technical Paper 880243, 1988, pp. 87-91, R. Davis et al. However, as indicated in the table, the actual luminance values at 12 volts of many of these colored phosphors is relatively low as compared to their ideal luminances.

TABLE 1

| EMISSION COLOR | Ideal Perceived Luminances and Present Phosphor Luminances at 12 Volts DC ($cd/m^2 \times 0.2919$) IDEAL RELATIVE LUMINANCE (%) | IDEAL LUMINANCE FOR AUTOMOBILES ($cd/m^2$) | LUMINANCE AT Eb = 12Vdc ($cd/m^2$) |
|---|---|---|---|
| Blue-Green | 100 | 2000 | 2000 |
| Blue | 25 | 500 | 52 |
| Yellow-Green | 50 | 1000 | 300 |
| Lemon | 50 | 1000 | 540 |
| Yellow | 50 | 1000 | 900 |
| Orange | 40 | 800 | 660 |
| Reddish-Brown | 40 | 800 | 350 |
| Reddish-Orange | 25 | 500 | 196 |
| Red | 15 | 300 | 105 |

The ideal relative luminance efficiency is that which would be required to achieve ideal color balancing of the light emitted by the individual phosphors of the display and the optical response of the human visual system. The ideal luminance for automobiles would be that luminance required to be visible in an automotive environment. The unit of ($cd/m^2$) is candela per square meter.

In addition, the threshold voltages ($V_{TH}$) needed to start light emission from the phosphor 16 varies with color, as illustrated in the following table, which is also reproduced from SAE Technical Paper 880243. The table pairs the emission color with the composition of the phosphor 16.

TABLE 2

| EMISSION COLOR | Threshold Voltages to Start Emission ($V_{TH}$) PHOSPHOR COMPOSITION | VTH |
|---|---|---|
| Blue-Green | ZnO:Zn | 3.5 |
| Blue | ZnS:[Zn] + $In_2O_3$ | 6.5 |
| Yellow-Green | ZnS:Cu,Al + $In_2O_3$ | 6.0 |
| Lemon | $(Zn_{0.55}Cd_{0.45})S$:Ag,Cl + $In_2O_3$ | 4.5 |
| Yellow | $(Zn_{0.50}Cd_{0.50})S$:Ag,Cl + $In_2O_3$ | 4.5 |
| Orange | $(Zn_{0.40}Cd_{0.60})S$:Ag,Cl + $In_2O_3$ | 4.5 |
| Reddish-Brown | $(Zn_{0.30}Cd_{0.70})S$:Ag,Cl + $In_2O_3$ | 3.5 |
| Reddish-Orange | $(Zn_{0.22}Cd_{0.78})S$:Ag,Cl + $In_2O_3$ | 3.5 |
| Red | $(Zn_{0.15}Cd_{0.85})S$:Ag,Cl + $In_2O_3$ | 3.5 |

Consequently, a vacuum fluorescent display employing different color phosphor compositions will inherently require different on-current levels to produce an ideal or chosen balance of colors across the entire display as perceived by a human observer.

A specific example of the present invention is described as follows. For typical red, yellow-green and blue vacuum fluorescence phosphors 16, operating at 12 Volts, the brightness under typical reasonable display operating conditions is generally 105 $cd/m^2$ for the red phosphor, 30 $cd/m^2$ for the yellow-green phosphor, and 52 $cd/m^2$ for the blue phosphor. Accordingly, the ratio of the widths of the channels 36 for the red:yellow-green:blue colored pixels 10 is 2.9:1.0:5.8 to achieve a uniform brightness among the three colors. For a reconfigurable vacuum fluorescent display with approximately 500 micron $\times$ 500 micron phosphor dots, using polycrystalline silicon thin film transistors in accordance with this invention, the appropriate channel widths for the resulting driver transistors 34 are correspondingly in the ratio of 2.9 microns for the red pixel driver transistors 34: 1.0 microns for the yellow-green pixel driver transistors 34: and 5.8 microns for the blue pixel driver transistors 34. However, the actual channel widths 36 depend upon the particular properties of the material, and therefore the material constant Beta (from equation 2), for the driver transistor 34. For example, the use of polysilicon transistors, as preferred, will require a wider channel than a similar embodiment using single crystal silicon. It will also be apparent to those skilled in the art that these channel widths 36 may be further scaled in order to allow for larger or smaller phosphor dot sizes, which would require correspondingly larger or smaller drive currents, or to allow for different choices of phosphor or for different relative luminances between the phosphors.

For example, the effect of varying the width of channel 36 upon on-current through a p-channel MOSFET driver transistor 34 is as follows. It has been shown that as the width of the channel 36 is increased from, say, about 100 microns to about 1000 microns, the on-current at a gate voltage of $-16$ volts and a drain voltage of 9 volts increases from about $-2\times10^{-5}$ amps to about $-2\times10^{-4}$ amps. It will be readily understood by those skilled in the art that the dimensions of the transistor channel 36 and the on-currents provided above are merely suggestive and are not to be construed as the optimum or desirable values of channel width and on-current.

In order to determine the appropriate capacitor size 32 relative to the variations in driver channel width 36, one would first consider the most inefficient phosphor 16 being used in the display and determine the appropriate width of the corresponding driver transistor channel 36 in accordance with the teachings of this invention. This would represent the widest driver transistor 34 required for the given display. The total area of the driver transistor 34, that is the channel width 36 times length, would then determine the capacitance of the driver transistor. This represents the minimum capacitance value for use in this particular display. One would then evaluate the leakage rate of charge off of this capacitance; the dominant source of leakage is typically the channel of the select transistor(s). For the desired display operating conditions, the product of this leakage resistance and the transistor capacitance gives a minimum time constant for charge retention on the driver transistor 34. If this time constant is large as compared to the inverse of the refresh rate of the display, then this type of pixel needs no additional storage capacitor. If this time constant is smaller than the inverse of the refresh rate, then additional capacitance, in the form of a storage capacitor 32, will be required for this type of pixel. The additional capacitance can be incorporated as shown in FIG. 4, such that the total capacitance of the storage capacitor 32 plus the driver transistor 34 yields a time constant which is larger than the inverse of the display refresh rate. It should be noted that the ratio of length to width of the storage capacitor 32 is at the discretion of the circuit designer and is not critical to the invention.

Based on this total capacitance per pixel for a given display configuration and refresh rate, it is then possible to evaluate the required storage capacitance for the next type of phosphor-pixel. Again, the dimensions of the driver transistor 34 for this phosphor 16 will be determined by the material properties of the phosphor 16 (represented by Alpha in Equation 1) and of the transistor (represented by Beta in Equation 2), and the product of transistor width 36 and length will be proportional to the driver transistor 34 capacitance. Then, the difference between the total capacitance required per pixel and the capacitance of the driver transistor 34 will determine the size of the required storage capacitor 32. A similar procedure would be followed for each type of pixel in the display.

Therefore, while our invention has been described in terms of preferred embodiments, it is apparent that other forms of the device could be adopted by one skilled in the art, such as although there are advantages to the use of p-channel transistors for this application, the intent of the present invention could also be met through the use of an n-channel transistor, or alternatively some combination of p-channel and n-channel devices. In addition, another alternative transistor configuration would be the redundant addressing scheme described in copending U.S. patent application Ser. No. 07/673,611. Also, it is clear that these teachings could be used with conventional single crystal or silicon-on-insulator materials, or with modified processing parameters. It is therefore readily observable by those skilled in the art that there are other parameters which can affect on-current, including the specific processes used, the thicknesses of the different materials used, and the length of the channel 36. Accordingly, the scope of our invention is to be limited only by the following claims.

The embodiments of this invention in which an exclusive property or privilege is claimed are defined as follows:

1. A pixel switch circuit for a pixel within an active matrix vacuum fluorescent display, said pixel having a phosphor with a predetermined luminous efficiency, a predetermined row address on an electrically conductive row, a predetermined column address on an electrically conductive column, and a ground, said pixel switch circuit comprising:

select means for selecting said pixel switch circuit from signals received via said predetermined row address and said predetermined column address, said select means being in electrical contact with said electrically conductive row and said electrically conductive column, said select means having a drain electrode;

a driver transistor having a gate electrode in electrical contact with said drain electrode of said select means, a drain electrode in electrical contact with said ground, and a source electrode in electrical contact with said phosphor, said driver transistor having a channel defined at a first end thereof by said source electrode and at an oppositely disposed second end thereof by said drain electrode;

capacitance means associated with said driver transistor, said capacitance means having a storage capacitance associated therewith so as to attain a predetermined charge storage capability associated with said pixel switch circuit;

control means for controlling storage of a charge on said capacitance means, said control means being in electrical contact with said electrically conductive row and said electrically conductive column; and wherein said channel has a predetermined geometry, said predetermined geometry having a dimension which is sized to be inversely proportional to said predetermined luminous efficiency of said phosphor, said geometry determining in part said predetermined charge storage capability of said pixel switch circuit.

2. A pixel switch circuit as recited in claim 1 wherein said dimension is a width of said channel.

3. A pixel switch circuit as recited in claim 1 wherein said pixel is one of a plurality of pixels within an active matrix vacuum fluorescent display.

4. A pixel switch circuit as recited in claim 1 wherein said select means and said control means are provided by at least one select transistor.

5. A pixel switch circuit as recited in claim 4 wherein said at least one select transistor has a gate electrode in electrical contact with said electrically conductive row, a source electrode in electrical contact with said electrically conductive column, and a drain electrode in electrical contact with said driver transistor.

6. A pixel switch circuit as recited in claim 1 wherein said capacitance means is provided within said driver transistor and a distinct charge storage capacitor, said distinct charge storage capacitor being in electrical contact with said drain electrode of said select means.

7. A pixel switch circuit as recited in claim 6 wherein said driver transistor has a transistor capacitance associated therewith and said distinct charge storage capacitor has a storage capacitance associated therewith, said storage capacitance being inversely proportional to said transistor capacitance so as to attain said predetermined charge storage capability associated with said pixel switch circuit.

8. A pixel switch circuit as recited in claim 1 wherein said predetermined luminous efficiency of said phosphor is substantially determined by a wavelength which is fluoresced by said phosphor.

9. A pixel switch circuit for an active matrix vacuum fluorescent display which has a plurality of pixels, each of said plurality of pixels having a phosphor with a predetermined luminous efficiency, a predetermined row address on an electrically conductive row, a predetermined column address on an electrically conductive column, and a ground, said pixel switch circuit comprising:

at least one select transistor having a gate electrode in electrical contact with said electrically conductive row, a source electrode in electrical contact with said electrically conductive column, and a drain electrode;

a driver transistor having a gate electrode in electrical contact with said drain electrode of said at least one select transistor, a drain electrode in electrical contact with said ground, and a source electrode in electrical contact with said phosphor, said driver transistor having a transistor capacitance associated therewith;

a distinct charge storage capacitor in electrical contact with said drain electrode of said at least one select transistor and said ground, said distinct charge storage capacitor having a storage capacitance associated therewith, said storage capacitance being inversely proportional to said transistor capacitance associated with said driver transistor so as to attain a predetermined charge storage capability associated with said pixel switch circuit; and a charge carrier channel associated with said driver transistor, said channel having a predetermined width which is sized to be inversely proportional to said predetermined luminous efficiency of said phosphor, said width determining in part said transistor capacitance of said driver transistor.

10. A pixel switch circuit as recited in claim 9 wherein said gate electrode of said driver transistor has a gate region associated therewith, said drain electrode has a drain region associated therewith, and said source electrode has a source region associated therewith.

11. A pixel switch circuit as recited in claim 10 wherein said drain region, said source region and said gate region are doped so as to be electrically p-type, effective to provide a p-channel MOSFET device.

12. A pixel switch circuit as recited in claim 11 wherein said drain, said source region and said gate region are doped with an element having 3 valence electrons.

13. In an active matrix vacuum fluorescent display having a plurality of pixels, said plurality of pixels each including a phosphor with a predetermined luminous efficiency, a predetermined row address on an electrically conductive row, a predetermined column address on an electrically conductive column, a ground, and a pixel switch circuit, wherein the improvement comprises:

select means within said pixel switch circuit for selecting said predetermined row address and said predetermined column address of said pixel, said select means being in electrical contact with said electrically conductive row and said electrically conductive column, said select means having a drain electrode, a driver transistor having a gate electrode in electrical contact with said drain electrode of said select means, a drain electrode in electrical contact with said ground, and a source electrode in electrical contact with said phosphor, said driver transistor having a channel defined at a first end thereof by said source electrode and at an oppositely disposed second end thereof by said drain electrode;

capacitance means within said pixel switch circuit and associated with said driver transistor, said capacitance means having a storage capacitance associated therewith so as to attain a predetermined charge storage capability associated with said pixel switch circuit;

control means within said pixel switch circuit for controlling storage of a charge on said capacitance means, said control means being in electrical contact with said electrically conductive row and said electrically conductive column; and wherein said channel has a predetermined width which is sized to be inversely proportional to said predetermined luminous efficiency of said phosphor, said width determining in part said predetermined charge storage capability.

14. A reconfigurable active matrix vacuum fluorescent display having a plurality of pixels, an electrically conductive row corresponding to a row of said plurality of pixels, an electrically conductive column corresponding to a column of said plurality of pixels, a pixel switch circuit, and a ground, said reconfigurable active matrix vacuum fluorescent display comprising:

a red phosphor associated with a first predetermined row address and a first predetermined column address of said reconfigurable active matrix vacuum fluorescent display, said red phosphor having a brightness proportional to approximately 105 $cd/m^2$;

a yellow-green phosphor associated with a second predetermined row address and a second predetermined column address of said reconfigurable active matrix vacuum fluorescent display, said yellow-green phosphor having a brightness proportional to approximately 300 $cd/m^2$;

a blue phosphor associated with a third predetermined row address and a third predetermined column address of said reconfigurable active matrix vacuum fluorescent display, said blue phosphor having a brightness of approximately 52 $cd/m^2$;

at least one select transistor associated with each of said red phosphor, said yellow-green phosphor, and said blue phosphor, said at least one select transistor having a gate electrode in electrical contact with a corresponding one of said electrically conductive rows, a source electrode in electrical contact with a corresponding one of said electrically conductive columns, and a drain electrode;

a first driver transistor associated with said red phosphor, said first driver transistor having a gate electrode in electrical contact with said drain electrode of a corresponding one of said at least one select transistor, a drain electrode in electrical contact with said ground, and a source electrode in electrical contact with said red phosphor, said driver transistor having a transistor capacitance associated therewith, said first driver transistor having a first channel;

a second driver transistor associated with said yellow-green phosphor, said second driver transistor having a gate electrode in electrical contact with said drain electrode of a corresponding one of said at least one select transistor, a drain electrode in electrical contact with said ground, and a source electrode in electrical contact with said yellow-green phosphor, said driver transistor having a transistor capacitance associated therewith, said second driver transistor having a second channel;

a third driver transistor associated with said blue phosphor, said third driver transistor having a gate electrode in electrical contact with said drain electrode of a corresponding one of said at least one select transistor, a drain electrode in electrical contact with said ground, and a source electrode in electrical contact with said blue phosphor, said driver transistor having a transistor capacitance associated therewith, said third driver transistor having a third channel;

a distinct charge storage capacitor in electrical contact with said drain electrode of each of said select transistors and said ground, said distinct charge storage capacitor having a storage capacitance associated therewith, said storage capacitance being inversely proportional to said transistor capacitance associated with each of said corresponding driver transistors so as to attain a predetermined charge storage capability associated with each of said pixel switch circuits; and wherein said first, second and third channels have corresponding predetermined widths having a ratio of approximately 2.9:1.0:5.8, respectively, each of said predetermined widths determining in part said predetermined charge storage capability of each of said corresponding pixel switch circuits.

* * * * *